United States Patent [19]

Carlton

[11] Patent Number: 4,727,704

[45] Date of Patent: Mar. 1, 1988

[54] GRATING STRUCTURE AND METHOD FOR ASSEMBLY

[75] Inventor: Donald G. Carlton, Denton, Tex.

[73] Assignee: Fibergrate Corporation, Dallas, Tex.

[21] Appl. No.: 47,621

[22] Filed: May 7, 1987

[51] Int. Cl.[4] ..... E04C 2/42

[52] U.S. Cl. ..... 52/667; 52/177

[58] Field of Search ..... 52/667, 177

[56] References Cited

U.S. PATENT DOCUMENTS

| | | | |
|---|---|---|---|
| 856,131 | 6/1907 | Canda | 52/667 |
| 1,946,035 | 2/1934 | Reuter | 52/667 X |
| 2,064,335 | 12/1936 | Bayley | 52/106 |
| 3,383,822 | 5/1968 | Viehmann et al. | 52/667 |
| 3,469,359 | 9/1969 | Nagin | 52/177 |
| 3,528,210 | 9/1970 | Johnson et al. | 52/667 X |
| 4,555,886 | 12/1985 | Wiechowski | 52/667 |

*Primary Examiner*—Alfred C. Perham

*Attorney, Agent, or Firm*—Richards, Harris, Medlock & Andrews

[57] ABSTRACT

An interlock grate structure is provided which includes longitudinal load bearing span bars having lateral locating holes spaced therealong for receiving transverse tie bars, the transverse tie bars having axial locking means which engage the longitudinal span bars at the point of juncture to prevent axial displacement of the tie bar relative to the span bar. A longitudinal lock rod serves to interlock the position of the transverse tie bar locking means with respect to the longitudinal span bar.

7 Claims, 4 Drawing Figures

FIG. 1
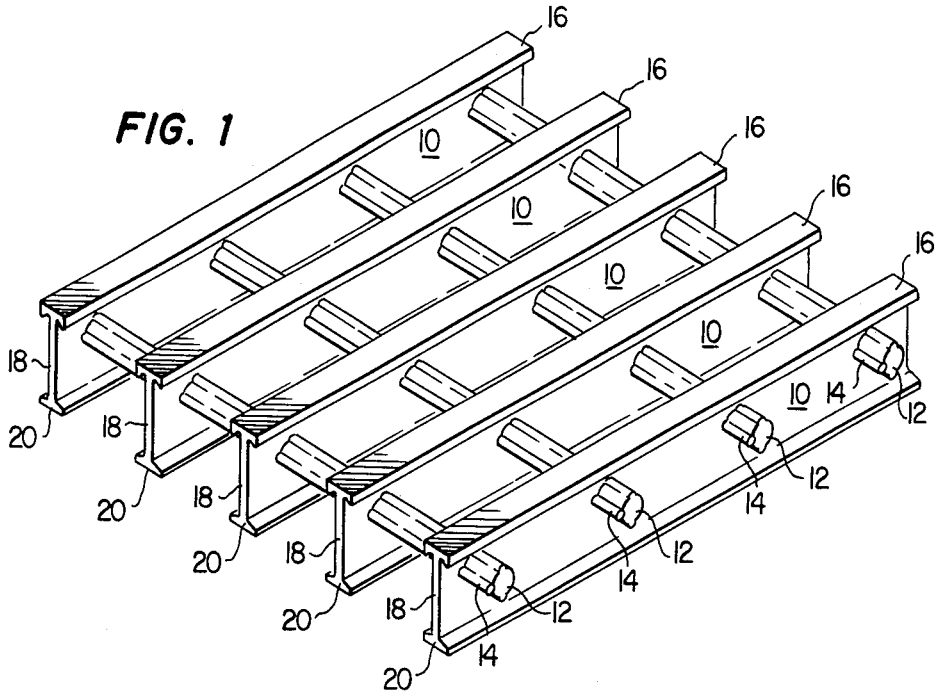
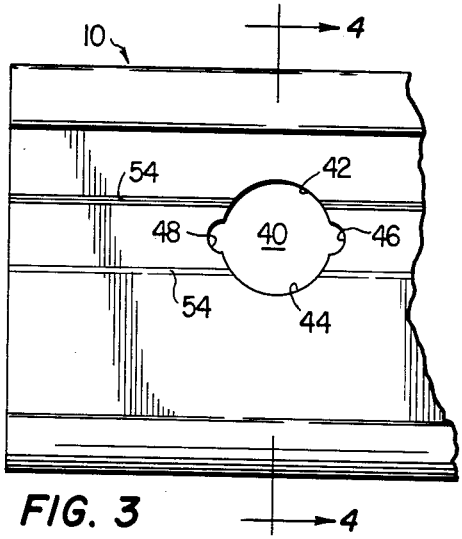
FIG. 3
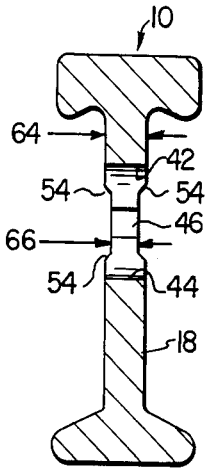
FIG. 4

GRATING STRUCTURE AND METHOD FOR ASSEMBLY

TECHNICAL FIELD

This invention relates to an interlock grate structure and in particular to an improved interlock grate structure which includes longitudinal load bearing span bars, transverse tie bars having axial locking means which engage with the longitudinal span bar at the point of juncture and longitudinal lock bars to prevent displacement of the tie bar relative to the span bar.

BACKGROUND OF THE INVENTION

The present invention relates to the fabrication of load bearing grate structures typically employed, for example, in commercial and industrial floor, platform and system construction. In another aspect, the present invention relates to an at least three-piece grating system wherein grate structures of load bearing capacity can be efficiently constructed in an interlocking fashion which provides improved structural integrity as compared to multi-piece grate articles which have heretofore been available. In a still further aspect, this invention relates to a method of construction for producing grating articles from individual components which result in improved structural integrity of the grating as a result of the interaction of the components when assembled.

Load bearing grate structures, i.e., structures comprising longitudinal span bars fabricated to support commercial and industrial loads tied together with transverse tie bars, have been conventionally produced from a variety of materials, including wood, metals (such as steel or aluminum, etc.), and more recently, plastic materials, and in particular fiber reinforced plastic resins. In the latter case, "one-piece" grating structures have been fabricated wherein the longitudinal span bars and transverse tie bars are formed integrally during the molding process. In more conventional grating articles, however, the longitudinal span bars must be assembled, usually in parallel, using the transverse tie bars. In the past this assembly has been effected through use of welds or bonding materials as was appropriate for the particular materials from which the grate was being fabricated. In addition to such bonding at the junction between longitudinal span bars and transverse tie bar members, metal stakes and pins have been driven through the span bars and into the tie bars at the junction therebetween to form a mechanical bond therebetween. More recently, thermoplastic spacers in the form of a sleeve over the tie bars have been used in order to maintain spacing between longitudinal span bars. These prior art methods, in addition to being time consuming from a fabrication standpoint, have other drawbacks. For example, the use of metal stakes or pins to form a mechanical connection between span bars and tie bars produces a fracture of the material through which they are driven. This fracture is at precisely the point in the structure where maximum stress occurs under load. Thermoplastic spacers avoid this problem but are subject to deformation, thereby allowing shifts in the relationship between span bar and tie bar to occur under loading conditions. Further, when the grating structure is applied during construction, the use of such spacers becomes disadvantageous since the cutting of an aperture through the grate structure or other shaping of the sides of the grate structure allow the spacers to dislodge from their position on the tie bars, thus abrogating their effectiveness as mechanical locators for the span-tie bar intersection.

Thus, a more economical and efficient means for effecting a mechanical lock between tie bars and longitudinal span bars in grating structures is desirable.

SUMMARY OF THE INVENTION

According to the present invention, load bearing grate structures are provided which are easily fabricated from three separate types of pieces and which provide excellent durability and load bearing capabilities due to an improved mechanical joining between longitudinal span bars and transverse tie bars. Thus, the structures of the present invention generally can be fabricated from at least three separate pieces which interact to obtain the benefits noted above. The term "three piece" as used herein will be understood to refer to at least three components which interact and assemble in the manner discussed hereinbelow. It is further to be understood, however, that each or any of the "pieces" may in itself be formed from multiple parts or sections. The first such piece is a longitudinal span bar suitably constructed for the purpose of bearing the major load stresses which will be placed on the article during use. The longitudinal span bar structures include lateral locating holes spaced therealong at preselected distances dictating the interval at which connecting tie bars will be used in the particular structure. The second piece of the construction is the transverse tie bar which includes a plurality of axial locking means spaced therealong at predetermined distances which determine the width between the longitudinal span bars for the particular grate structure being fabricated. The axial locking means on the transverse tie bars are formed so as to engage the lateral holes in the longitudinal span bars in a manner so as to prevent axial displacement of the transverse tie bars with respect to each of the longitudinal span bars. Finally, the third piece of the construction comprises at least one longitudinal lock rod member which serves to engage the transverse tie bars and longitudinal span bars to prohibit removal of the tie bars from the locating holes.

The grating articles of the present invention, which can be fabricated from wood, metals or in a preferred embodiment, fiber reinforced plastic resin materials, provide for a mechanically interlocked span-tie bar intersection which can be produced in a variety of configurations and are relatively easy to assemble.

BRIEF DESCRIPTION OF THE DRAWINGS

For a more complete understanding of the present invention and for further advantages thereof, reference is now made to the following Description of the Preferred Embodiment taken in conjunction with the accompanying Drawings, in which:

FIG. 1 is a perspective view of one embodiment of the grate structure of the present invention;

FIG. 3 is a side view of a longitudinal span bar showing a locating hole; and FIG. 4 is a cross-sectional view of a longitudinal span bar taken through line 4—4 in FIG. 3.

DESCRIPTION OF THE PREFERRED EMBODIMENT

Figure 2:
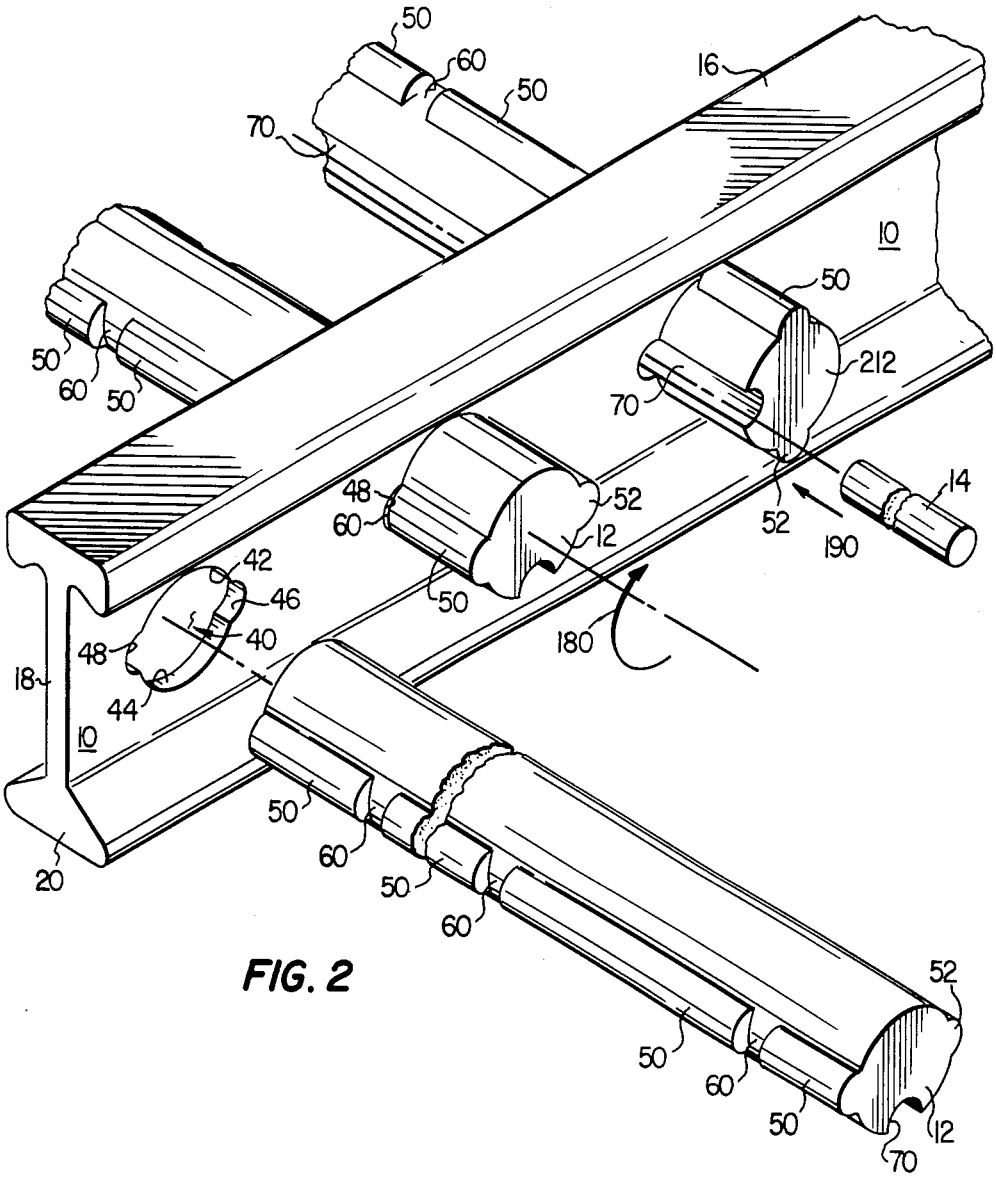
FIG. 2 is a perspective view of one embodiment of the grate structure of the present invention shown in an aligned but disassembled fashion.

The grating structures of the present invention are easy to assemble, provide positive mechanical interlock of the junction between span bars and transverse tie bars without a reduction in mechanical strength caused by the use of retaining fasteners or pins and without the need for the use of additional spacers, can be fabricated from a variety of materials and lend themselves to either mechanized or manual fabrication techniques. Because the cross-section of the three separate types of pieces which are used to construct the grate structure is substantially constant (except for grooves and holes as described further hereinbelow) fabrication by pultrusion techniques is possible. These techniques are especially useful when the material being employed is fiber reinforced plastic resin material. Thus, by using a suitable mixture of thermosetting plastic resin materials (for example, a mixture of polyester resins, styrene monomer, solvent and filler materials, in combination with a catalyst, and employed with glass fibers), pultrusion of the three types of pieces necessary to form the grating system can be effected economically while obtaining the excellent corrosion resistance, nonconductivity and durability of structures formed from such materials. It will be understood that while fiber reinforced plastic resin materials are one preferred material for use in fabrication of the present invention, other materials such as wood, composites, metals, etc., and combinations of these materials with plastics are also contemplated.

The first of the three construction pieces of the grating system of the present invention are longitudinal span bars which are sometimes referred to as load bearing bars in that their cross-sectional configuration is designed to properly support the contemplated loads which are to be imposed upon the grating structure. The span bars of the grating structures of the present invention, regardless of cross-sectional configuration, comprise lateral locating holes through which pass the transverse tie bars further described hereinbelow.

The transverse tie bars of the grating structure, while certainly adding to the load bearing characteristics of the grate structure, do not normally bear the major portion of the load, if any, which the structure is designed to bear. It will be understood that the major portion of the load, or all the load, is to be borne by the longitudinal span bars. The main function of the transverse tie bars is to fix the parallel relationship between the longitudinal span bars. Typically, the transverse tie bars have a cross-sectional configuration in which an axial locking means comprises a slot designed to engage the lateral locating holes of the span bars. Further, the transverse tie bars have at least one elongated groove extending along its axial length. This groove is sized to receive and locate a longitudinal lock rod, described below.

The longitudinal lock rod of the at least three-piece grate structure of the present invention serves to lock the transverse tie bars in engagement with the lateral locating holes in the span bars, and thereby form a tie bar-span bar junction which restricts axial motion of the tie bars. In particular, the tie bars are inserted through the lateral locating holes in the longitudinal span bars, and are then rotated approximately 90° to interlock the axial locking means of the transverse tie bar to restrict the axial motion of the tie bars, and align at least one groove located in each tie bar with the aligned locating holes to allow insertion of the lock rod member.

In the preferred embodiment of the present invention, the lock rod members are equal in length to the tie bar members so that the tie bars, in effect, become reinforced by the presence of the lock rods. However, it will be understood that the lock rod members may be of a length shorter than the transverse tie bars so as to only engage with a limited number of span bars, that number of span bars being less than the total number of span bars engaging with and locked by the respective transverse tie bars, and that a lock rod of any length sufficient to engage with at least one transverse tie bar will be sufficient to lock the transverse tie bar in a rotated position within the respective locating holes in the span bars.

It will be further understood that the tie bar members and lock rod members may be joined by means such as gluing, riveting, or by any other suitable means. In particular, if the tie bar members and lock rod members are made of a reinforced plastic resin, then they may be glued by applying glue to the terminal ends of each, or at a plurality of locations across the entire interface of the tie bar and lock rods, or the glue may be smeared across the entire interface of the tie bar and lock rods. Further, it will be understood that glue may also be employed on the external surface of the tie bar members and be located in the plurality of holes in the span bars so as to form an integral grate structure.

Referring now to FIG. 1, the assembled grate structure of the present invention is shown having a plurality of longitudinal span bars 10 being arranged in a substantially parallel configuration, and secured in this configuration by a plurality of transverse tie bars 12. Transverse tie bars 12 are secured in their locked position, holding longitudinal span bars in their parallel configuration, by longitudinal lock rods 14. As shown, only one lock rod 14 is used for each transverse tie bar 12. It should be understood that more than one lock rod 14 may be used for each transverse tie bar 12. It will be noted that longitudinal span bars 10 have a load bearing surface 16 and a flank 18 extending below surface 16 to engage with the respective transverse tie bars 12 and longitudinal lock rods 14.

As shown in FIG. 1 each longitudinal span bar 10 is of a substantially "I-beam" construction having a load bearing portion 16, a flank 18 and a butt 20. Butt 20 has a configuration substantially similar to the upper load bearing portion 16. It will be understood, however, that in alternate embodiments of the present invention, longitudinal span bars 10 may simply have an upper load bearing surface 16 and a vertical flank 18 formed in the shape of a "T", or a vertical flank 18 without an upper or lower surface, or a vertical flank 18 with only a lower butt 20.

The distance between each longitudinal span bar 10 may be predetermined to assure that the grating structure of the present invention provides a sufficient load support for any contemplated load. In particular, the width between span bars 10 may be either increased or decreased depending upon the load strength of each individual longitudinal span bar 10.

Referring now to FIG. 2, longitudinal span bar 10 is shown having upper load bearing portion 16, vertical flank 18 and lower butt 20 to form a substantially "I-beam" structure. In longitudinal span bar 10 are located holes 40 which are a void in flank 18 defined by upper arcuate surface 42 and lower arcuate surface 44 (as can best be seen in FIG. 3). It will be understood that arcuate surfaces 42 and 44 have substantially identical radii of curvatures. Hole 40 is further defined by oppositely disposed side arcuate surfaces 46 and 48. Side arcuate surfaces 46 and 48 are located between upper arcuate surface 42 and lower arcuate surface 44. It will be understood by one of ordinary skill in the art that hole 40 may be produced by first drilling two holes through flank 18 to form surfaces 46 and 48 and then drilling a larger hole to form surfaces 42 and 44. Hole 40 may also be produced by using a router or any other suitable method.

It will be further understood by one of ordinary skill in the art that each longitudinal span bar will have a plurality of holes 40 located in their respective flanks 18, which holes will be spaced at a predetermined interval on each span bar, and that the interval of spacing will be identical in each span bar, so that when the span bars are placed in a substantially parallel configuration each hole in flank 18 will be aligned with similar holes 40 located in the respective flanks of the other span bars 10.

Also shown in FIG. 2 is transverse tie bar 12. Tie bar 12 is of a substantially circular cross-section with protruding lobes 50 and 52 located at predetermined intervals on opposite sides of bar 12. Lobes 50 and 52 are of arcuate configuration having an outside diameter substantially equal to the inside diameter of arcuate surfaces 46 and 48 in locating holes 40. Further, it will be understood that the outside diameter of transverse tie bars 12 will be substantially equal to the inside diameter of arcuate surfaces 42 and 44, and that lobes 50 and 52 will be positioned on the outside surface of tie bars 12 so as to match with arcuate surfaces 48 and 46, respectively, when transverse tie bars 12 are inserted into holes 40. Between successive lobes 50 and successive lobes 52 on transverse tie bars 12 are slots 60. It will be understood that slots 60 between lobes 50 are of equal width as slots 60 between lobes 52, and are sized so as to engage flank 18 when transverse tie bars 12 are inserted into holes 40, and to permit rotation of transverse tie bars 12 when so inserted into holes 40.

When the respective span bars 10 and transverse tie bars 12 are in the proper alignment, transverse tie bars 12 are rotated 90° as shown by arrow 180, thus moving slots 60 away from arcuate surfaces 48 and 46, and engaging flank 18. Further, rotation of transverse tie bars 12 brings groove 70 into alignment with arcuate surface 48 to create a passage between flank 18 and transverse tie bar 12 sized to receive lock rod 14, and allow lock rod 14 to slidably engage with bar 12 and the succession of span bars 10 contacted by bar 12.

Transverse tie bar 212 is shown in position after a rotation of 90° where slots 60 engage with flank 18 to prohibit axial movement of transverse tie bar 212 with respect to span bar 10. At this point at least one lock rod 14 is inserted (as shown by arrow 190) between span bar 10 and transverse tie bar 212 along groove 70 so as to engage with groove 70 and arcuate surface 48, located in each span bar. Lock rod 14 prohibits the rotation of transverse tie bar 212 with respect to span bar 10, thus prohibiting the disassembly of the grating structure without the complete removal of lock rod 14.

Referring to FIG. 4, it can be seen that flank 18 does not have a uniform cross-sectional width. From some point below upper arcuate surface 42 to some point above lower arcuate surface 44, width 64 slopes forming a ramp as at 54 to form width 66, width 64 being greater than width 66. Ramps 54 allow momentum to be built up in the 90° twisting of each tie bar 12 before slots 60 engage with flank 18.

It will be understood that lock rod 14 may be of a length substantially identical to the length of transverse tie bar 212, thus contacting groove 70 across its entire surface. Transverse tie bar 212 and lock rod 14 may be glued by applying glue to the terminal ends of each, or at a plurality of locations across the entire surface of transverse tie bar 212 and lock rod 14, or the glue may be smeared across the entire interface of tie bar 212 and lock rod 14. Further, it will be understood that glue may also be employed on the external surface of the tie bar members at slots 60 and be located in the plurality of holes at arcuate surfaces 46 and 48 in the respective span bar so as to form a glue junction with slots 60 when the slots contact flank 18 after rotation of the transverse tie bar.

Although preferred embodiments of the invention have been described in the foregoing Description of the Preferred Embodiment and illustrated in the accompanying Drawings, it will be understood that the invention is not limited to the embodiments disclosed, but is capable of numerous rearrangements, modifications, and substitution of parts and elements without departing from the spirit of the invention. The present invention is, therefore, intended to encompass such rearrangements, modifications, and substitution of parts and elements as fall within the scope of the invention.

I claim:

1. A load bearing grate structure comprising:

a plurality of longitudinal span bars having lateral locating holes spaced therealong;

a plurality of transverse tie bars having a substantially circular cross-sectional shape with oppositely disposed protruding lobes;

said lobes having slots cut in them so as to interference fit with said lateral locating holes; and said lateral locating holes on said longitudinal span bars further having holes sized to receive said oppositely disposed protruding lobes, whereby the transverse tie bars are slidably inserted into the holes in the span bars by aligning the lobes with the holes sized to receive them, and then twisting the tie bar approximately 90°, thus allowing the slots cut in the lobes to engage with the span bar;

longitudinal lock rods for holding said slots in engagement with said locating holes to prevent rotation of said tie bars with respect to said longitudinal span bars;

said transverse tie bars having first and second ends with at least one elongated groove extending from said first end to said second end; and said elongated groove being sized to slidably receive said lock rods.

2. A load bearing grate structure comprising:

a plurality of longitudinal span bars having lateral locating holes spaced therealong;

a plurality of transverse tie bars;

said transverse tie bars having a substantially circular cross-sectional shape with oppositely disposed protruding lobes;

said protruding lobes having slots cut in them so as to interference fit with said lateral locating holes;

said lateral locating holes on said longitudinal span bars further having holes sized to receive said oppositely disposed protruding lobes;

longitudinal lock rods for holding said tie bars in engagement with said locating holes to prevent rotation of said tie bars with respect to said longitudinal span bars;

said transverse tie bars having first and second ends and at least one elongated groove extending from said first end to said second end; and said elongated groove being sized to slidably receive said lock rods when said groove is matched with said holes sized to receive said protruding lobes.

3. The load bearing grate structure of claim 2, wherein said longitudinal lock rods are of substantially the same length as said transverse tie bars.

4. The load bearing grate structure of claim 2, wherein said longitudinal lock rods are chemically bonded to said transverse tie bars.

5. The load bearing grate structure of claim 2, wherein said longitudinal lock rods are designed so as to mechanically lock into position with respect to said transverse tie bars.

6. The load bearing grate structure of claim 2, wherein said longitudinal span bars comprise:

at least a vertical flank portion;

said vertical flank portion having a cross-sectional shape having at least one wide portion, at least one ramp portion and at least one narrow portion.

7. The load bearing grate structure of claim 2, wherein the cross-sections of said longitudinal span bars, said transverse tie bars and said longitudinal lock rods are substantially constant so that same can be produced by pultrusion techniques.

* * * * *